US007319577B2

(12) United States Patent
Dolan

(10) Patent No.: US 7,319,577 B2
(45) Date of Patent: Jan. 15, 2008

(54) SAFETY SHUT OFF FOR WATER HEATERS

(75) Inventor: Patrick M. Dolan, 4119 NE. 96th St., Seattle, WA (US) 98115

(73) Assignee: Patrick M. Dolan, Seattle, WA (US)

( * ) Notice: Subject to any disclaimer, the term of this patent is extended or adjusted under 35 U.S.C. 154(b) by 591 days.

(21) Appl. No.: 10/729,120

(22) Filed: Dec. 4, 2003

(65) Prior Publication Data

US 2005/0120980 A1 Jun. 9, 2005

(51) Int. Cl.
*H02H 5/04* (2006.01)

(52) U.S. Cl. ..... 361/103; 431/22

(58) Field of Classification Search ..... 361/103
See application file for complete search history.

(56) References Cited

U.S. PATENT DOCUMENTS 4,032,286 A * 6/1977 Kobayashi et al. ..... 431/76
4,396,370 A * 8/1983 Yamana et al. ..... 431/80
4,406,613 A * 9/1983 Naito et al. ..... 431/76
4,638,789 A * 1/1987 Ueki et al. ..... 122/14.21
5,548,277 A * 8/1996 Wild ..... 340/578
5,848,586 A * 12/1998 Garms ..... 122/13.01
6,139,311 A * 10/2000 Bowman et al. ..... 431/278
6,390,028 B1 * 5/2002 Langmead et al. ..... 122/14.2
6,401,668 B2 * 6/2002 Valcic ..... 122/14.31
6,412,447 B1 * 7/2002 Trant et al. ..... 122/14.21
6,435,140 B1 * 8/2002 Joyce ..... 122/13.01
6,474,979 B1 * 11/2002 Rippelmeyer ..... 431/67
6,508,207 B2 * 1/2003 Shellenberger et al. .. 122/14.31
2001/0009144 A1 * 7/2001 Valcic ..... 122/14.31
2001/0042564 A1 * 11/2001 Abraham et al. ..... 137/65
2002/0066420 A1 * 6/2002 Shellenberger et al. .. 122/14.31
2002/0134322 A1 * 9/2002 Dolan ..... 122/504
2005/0048427 A1 * 3/2005 Brown ..... 431/20

* cited by examiner

*Primary Examiner*—Ronald W. Leja
(74) *Attorney, Agent, or Firm*—FSP LLC

(57) ABSTRACT

A water heater includes a gas valve and a solenoid to operate the gas valve. A thermocouple of the water heater is heated by a pilot light to provide a current source to maintain the gas valve in an open position. A sensor activated switch switches current from a second current source to the solenoid to move the gas valve to a closed position.

14 Claims, 5 Drawing Sheets

SAFETY SHUT OFF FOR WATER HEATERS

TECHNICAL FIELD

The present disclosure relates to safety shut off circuits, and more particularly to safety shut off circuits for gas-fired water heaters.

BACKGROUND

Flammable substances such as gasoline may be used and/or stored in garages and other locations where gas-fired water heaters are located. Accidents may occur when the pilot light of the water heater ignites vapors produced from flammable household substances. Vapor fires typically begin in the ignition chamber of the water heater. One approach to preventing vapor fires is to adapt the water heater so that the flame arrestor plate remains below the auto-ignition temperature of the vapor outside the chamber when a vapor fire begins inside the combustion chamber. Serious accidents may still result when the vapor fire inside the chamber heats the arrestor plate to temperatures exceeding the auto-ignition temperature of the vapor outside the chamber. Furthermore, vapor fires within the combustion chamber may irreparably damage the water heater.

The United States Patent Application having publication number U.S. 2001/0038986 A1 describes a safety shutoff for gas water heaters, in which a vapor sensor is continuously monitored by a microprocessor. When vapor is present the impedance of the sensor is changed, and the microprocessor shuts off the gas flow valve. Disadvantages of this approach are the cost and complexity of implementing a microprocessor-based control system, and performance limitations of computational methods of control.

Another approach involving vapor sensors is described in the United States Patent Application having publication number U.S. 2001/0042564 A1. The variable impedance of the vapor sensor is placed in series with the current source provided by a thermocouple to maintain a gas valve in an open position. Locating the sensor impedance in series with the thermocouple may lead to unreliable operation, as the current provided to maintain the gas valve open depends upon both the temperature of the thermocouple and the impedance of the sensor. Furthermore, once closed, the gas valve will open again according to momentary fluctuations in the sensor impedance.

United States Patent Application having publication number U.S. 2002/0134320 A1 describes use of a combustion sensitive fuse. When the fuse is exposed to flame, the gas valve is closed. A vapor combustion situation must first arise before the gas is shut off.

Other references describing various techniques to suppress vapor fires, regulate a pilot light, and detect flame are U.S. 2001/0009144 A1
U.S. 2002/0066420 A1
U.S. Pat. No. 5,548,277
U.S. Pat. No. 5,848,586
U.S. Pat. No. 6,139,311
U.S. Pat. No. 6,390,028 B1
U.S. Pat. No. 6,401,668 B2
U.S. Pat. No. 6,412,447 B1
U.S. Pat. No. 6,435,140 B1
U.S. Pat. No. 6,474,979 B1
U.S. Pat. No. 6,508,207 B2
U.S. Pat. No. 6,554,608 B1
Europe December 1993 0 382 893 A1
Europe August 1996 0727 613 A1

SUMMARY

The following summary is intended to highlight and introduce some aspects of the disclosed embodiments, but not to limit the scope of the invention. Thereafter, a detailed description of illustrated embodiments is presented, which will permit one skilled in the relevant art to make and use aspects of the invention. One skilled in the relevant art can obtain a full appreciation of aspects of the invention from the subsequent detailed description, read together with the figures, and from the claims (which follow the detailed description).

A water heater includes a gas valve and a solenoid to operate the gas valve. A thermocouple of the water heater is heated by a pilot light to provide a current source to maintain the gas valve in an open position. A sensor activated switch switches current from a second current source to the solenoid to move the gas valve to a closed position. The sensor activated switch may include a silicon controlled rectifier (SCR) to switch current from the second current source to the solenoid. The SCR is selected such that the current from the second current source heats the SCR sufficiently to break a thermal fuse thermally coupled to the SCR, discontinuing current flow to the solenoid. The water heater may be reactivated by replacing the fuse.

BRIEF DESCRIPTION OF THE DRAWINGS

The headings provided herein are for convenience only and do not necessarily affect the scope or meaning of the claimed invention.

In the drawings, the same reference numbers and acronyms identify elements or acts with the same or similar functionality for ease of understanding and convenience. To easily identify the discussion of any particular element or act, the most significant digit or digits in a reference number refer to the figure number in which that element is first introduced.

DETAILED DESCRIPTION

The invention will now be described with respect to various embodiments. The following description provides specific details for a thorough understanding of, and enabling description for, these embodiments of the invention. However, one skilled in the art will understand that the invention may be practiced without these details. In other instances, well known structures and functions have not been shown or described in detail to avoid unnecessarily obscuring the description of the embodiments of the invention. References to "one embodiment" or "an embodiment" do not necessarily refer to the same embodiment, although they may.

Figure 1:
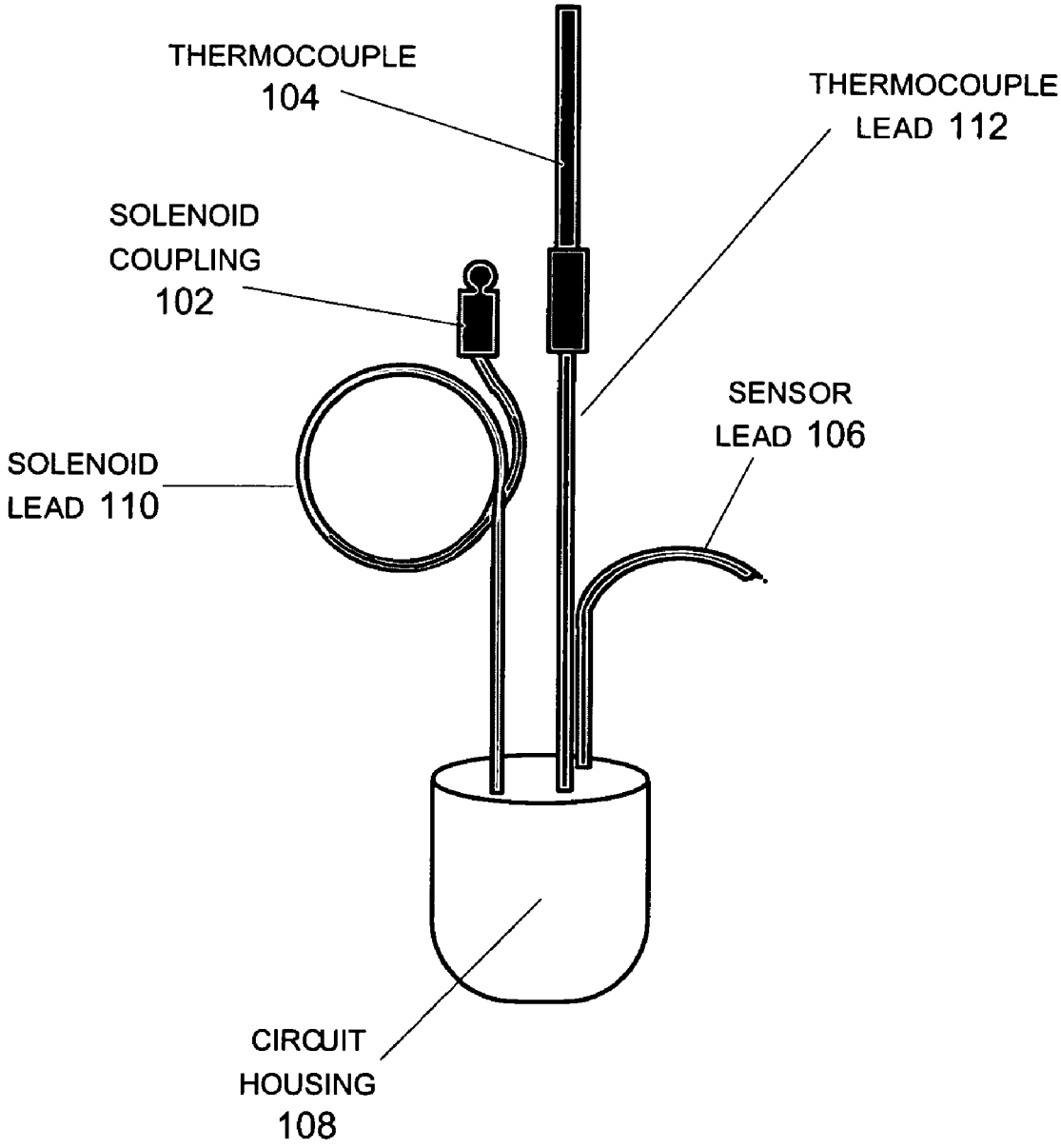
FIG. 1 is an illustration of an embodiment of a water heater safety shut off apparatus.

FIG. 1 is an illustration of an embodiment of a water heater safety shut off apparatus. A solenoid lead 110, thermocouple lead 112, and sensor lead 106 protrude from a circuit housing 108. The solenoid lead 110 couples the circuit housing 108 with a solenoid coupling 102. The thermocouple lead 112 couples the circuit housing 108 with a thermocouple 104. The sensor lead 106 couples the circuit housing 108 with a sensor, as shown in FIGS. 2 and 3.

Figure 2:
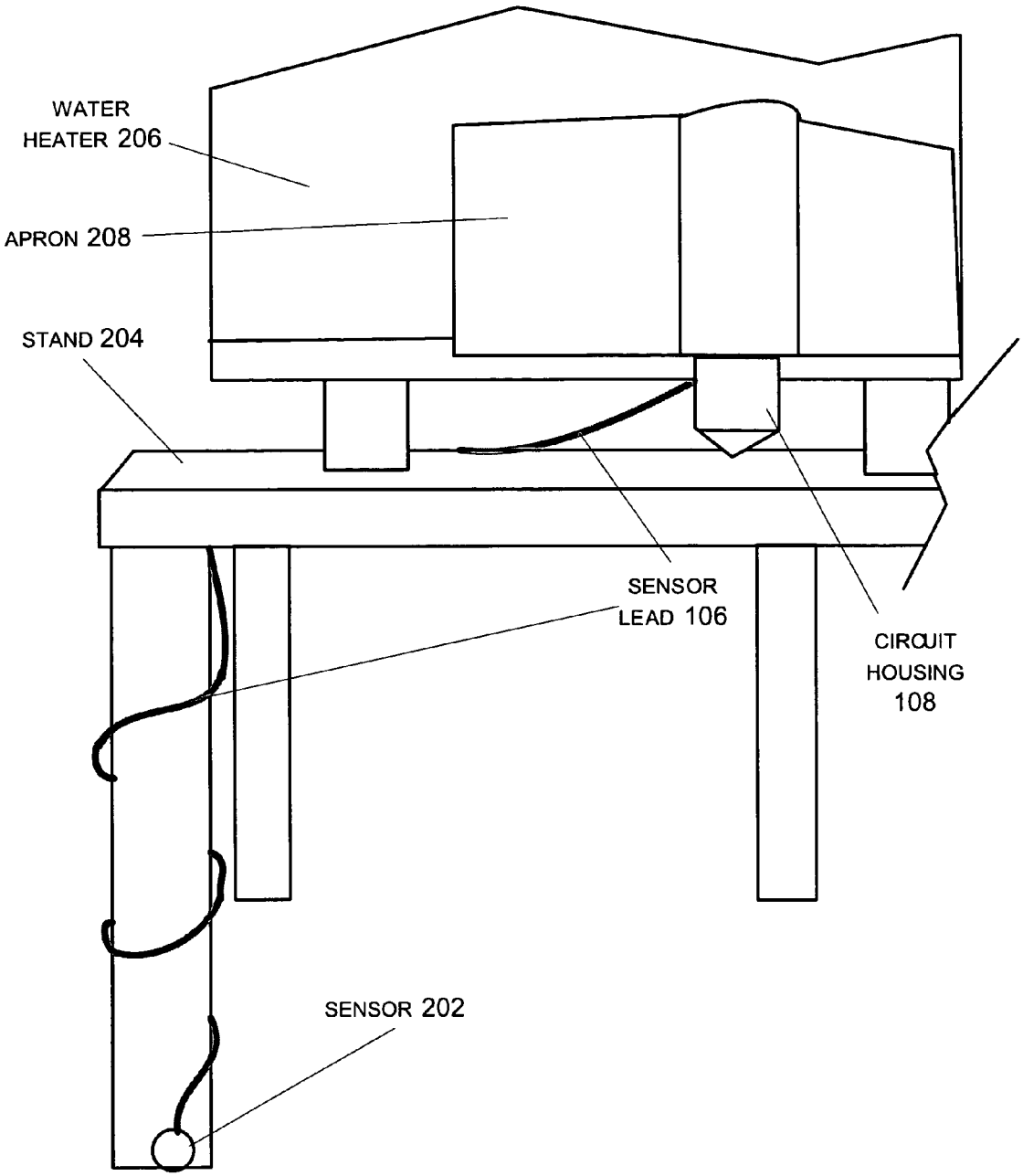
FIG. 2 is a front view illustration of an embodiment of a water heater safety shut off apparatus installed on a gas-fired water heater.

FIG. 2 is a front view illustration of an embodiment of a water heater safety shut off apparatus installed on a gas-fired water heater. The water heater 206 is mounted on a stand 204 and comprises an apron 208. The circuit housing 108 is mounted in proximity to the apron 208 and secured in place by 1) coupling the solenoid coupling 102 to a water heater 206 thermostat gas valve (typically part of a pilot light regulator of the water heater 206), which comprises a gas valve solenoid, and 2) by coupling the thermocouple 104 to the pilot light regulator. The sensor lead 106 couples the circuit housing 108 with a sensor 202.

Figure 3:
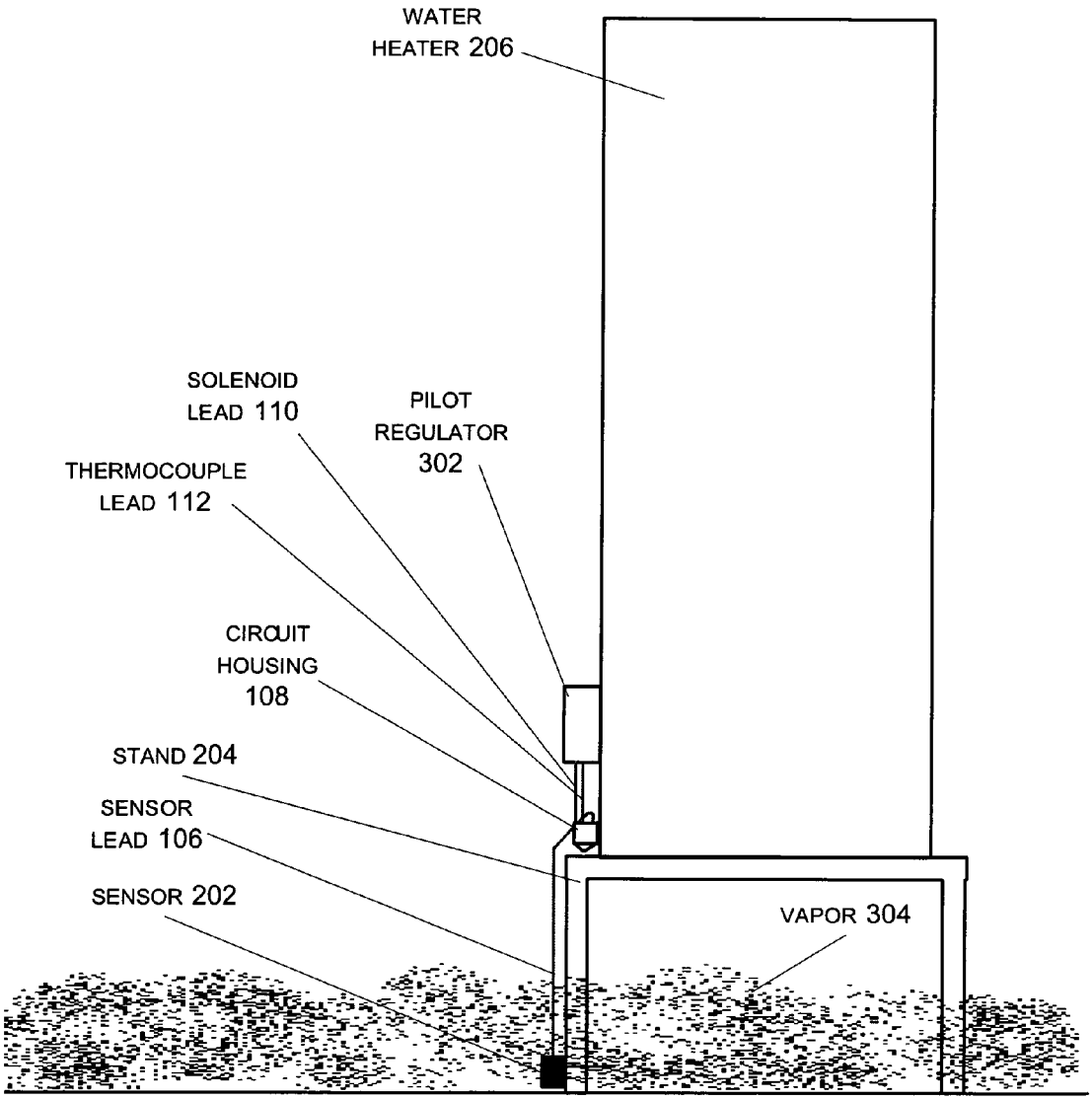
FIG. 3 is a side view illustration of an embodiment of a water heater safety shut off apparatus installed on a gas-fired water heater, where vapor is present near the water heater.

FIG. 3 is a side view illustration of an embodiment of a water heater safety shut off apparatus installed on a gas-fired water heater, where vapor is present near the water heater. The thermocouple 104 and the solenoid coupling 102 are coupled to a pilot light regulator 302. Under normal operation, a pilot light of the water heater 206 is maintained on, with the thermocouple 104 in thermal contact with the pilot light. The thermal contact between the pilot light and the thermocouple 104 results in a potential and current provided to the water heater's 206 gas valve solenoid via the thermocouple lead 112 and the solenoid lead 110. The potential and current provided to the solenoid by the thermocouple 104 maintain the solenoid in an open position, so that gas is available to the pilot light and the burner for ignition.

When vapor 304 is present near the sensor 202, electrical effects across the sensor lead 106 are propagated to the circuit housing 108, resulting in electrical effects on the solenoid lead 110 that cause the solenoid to close, resulting in an interruption of gas to the pilot light and burner, extinguishing flames.

Figure 4:
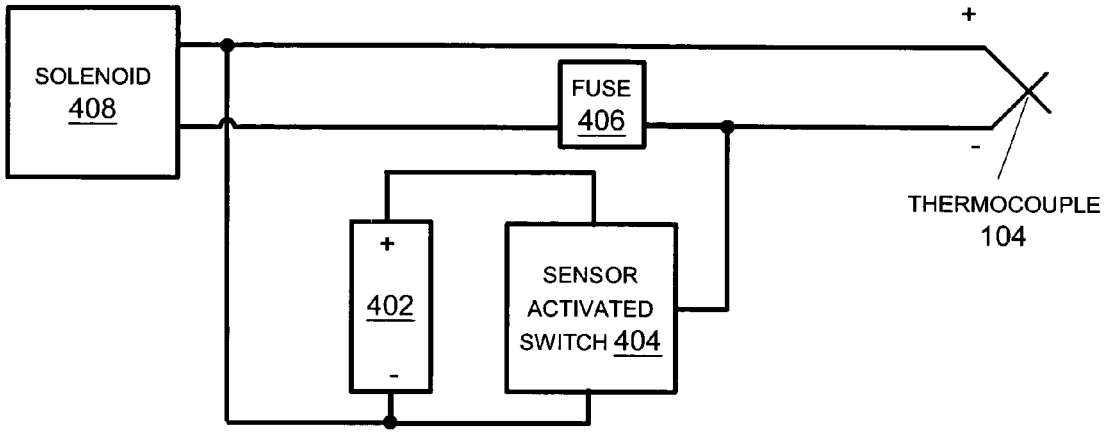
FIG. 4 is a block diagram of an embodiment of a safety shut off circuit.

FIG. 4 is a block diagram of an embodiment of a safety shut off circuit. The thermocouple 104, when heated, provides potential and current in a first direction to maintain the solenoid 408 in an open position. A second source 402 of potential and current, such as a battery, is coupled to the solenoid 408. The source 402 provides a potential and current in a second direction opposite to the current provided by the thermocouple 104. In other words, the source 402 is coupled to reverse bias the solenoid 408. A sensor-activated switch 404 gates the current from the source 402 to the solenoid 408. The switch 404 is normally open, so that current from the source 402 does not affect the solenoid 408.

When vapor 304 is present at the sensor 202, the sensor-activated switch 404 closes, and current is provided from the source 402 to reverse bias the solenoid 408. The solenoid 408 closes, interrupting the flow of gas to the pilot light and burner.

A fuse 406 may be provided to interrupt the flow of current to the solenoid 408 from both the thermocouple 104 and the source 402. The fuse 406 may be a thermal fuse, in thermal contact with elements of the switch 404, so that heating of the switch 404 resulting from the flow of current from the source 402 may cause the fuse 406 to heat and break. A break in the fuse 406 physically disconnects the current path between both the thermocouple 104 and the source 402.

Figure 5:
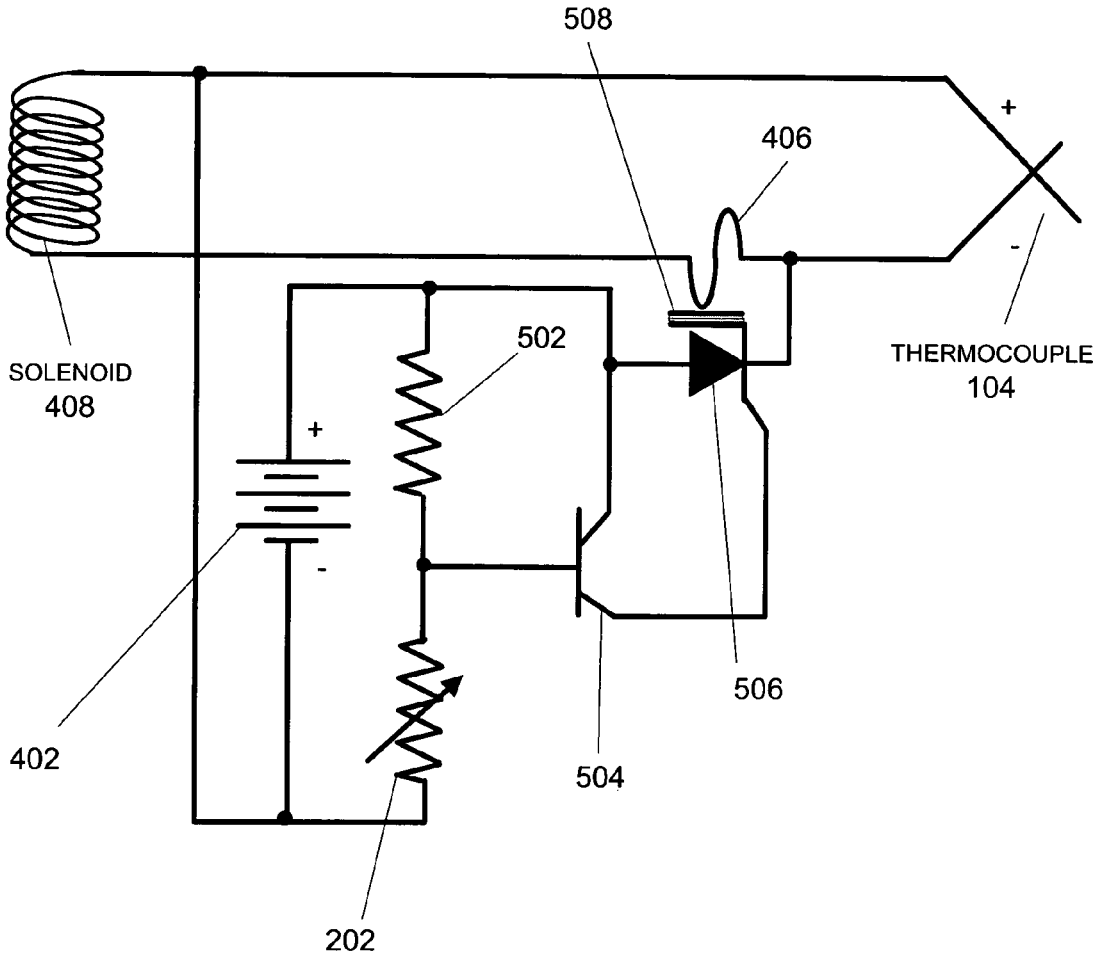
FIG. 5 is a circuit diagram of an embodiment of a safety shut off circuit.

FIG. 5 is a circuit diagram of an embodiment of a safety shut off circuit. The source 402 is a battery to provide current to reverse bias the solenoid 408. The sensor 202 provides a variable impedance element in the circuit. The impedance of the sensor 202 increases in the presence of vapor 304. Increasing the impedance of the sensor 202 increases a gate voltage of the transistor 504. The transistor 504 switches on, providing current to a gate of the silicon controlled rectifier (SCR) 506, causing the SCR 506 to open. Current then flows from the battery 402 through the SCR 506, through the fuse 406, to reverse bias the solenoid 408. The SCR 506 may be underrated, so that the SCR 506 is heated by the current provided by the battery 402. The SCR 506 may be in thermal contact with the fuse 406 via a thermal coupling 508. Heat from the SCR 506 may propagate via the thermal coupling 508 to the fuse 406, breaking the fuse 406. The thermal coupling 508 may be provided by gluing or otherwise securing the package of the fuse 406 to the package of the SCR 506.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

What is claimed is:

1. An apparatus comprising:

a solenoid lead;

a thermocouple to provide a first current source in a first direction to the solenoid lead; and a sensor activated switch disposed to switch current from a second current source to the solenoid lead in a second direction different from the first; and a vapor sensor having a resistance that increases with vapor concentration, the vapor sensor deployed so that an increase to the vapor sensor resistance activates the switch.

2. The apparatus of claim 1, further comprising:

the sensor activated switch comprising a silicon controlled rectifier (SCR) to switch current from the second current source to the solenoid lead, the SCR selected so that the current from the second current source heats the SCR sufficiently to break a thermal fuse coupled to the SCR.

3. The apparatus of claim 2, further comprising:

the second current source coupled to a gate of the SCR via a transistor.

4. The apparatus of claim 1, further comprising:

a fusable link coupling the solenoid lead with the thermocouple and coupling the solenoid lead with the second current source.

5. The apparatus of claim 4, further comprising:

the fusible link comprising a thermal fuse thermally coupled to an element of the sensor activated switch.

6. The apparatus of claim 1, further comprising:

the sensor activated switch comprising a thermally actuated circuit breaking device.

7. A water heater comprising:

a gas valve;

a solenoid to operate the gas valve;

a thermocouple that, when heated by a pilot light, provides a first current source to provide current in a first direction to maintain the gas valve in an open position; and a sensor activated switch disposed to switch current from a second current source to provide current in a second direction different from the first to the solenoid to move the gas valve to a closed position; and a vapor sensor having a resistance that increases with vapor concentration, the vapor sensor deployed so that an increase to the vapor sensor resistance activates the switch.

8. The water heater of claim 7, further comprising:

a fusable link coupling the solenoid with the thermocouple and coupling the solenoid with the second current source.

9. The water heater of claim 8, further comprising:

the fusible link comprising a thermal fuse thermally coupled to an element of the sensor activated switch.

10. The water heater of claim 7, further comprising:

the sensor activated switch comprising an SCR to switch current from the second current source to the solenoid, the SCR selected such that the current from the second current source heats the SCR sufficiently to break a thermal fuse thermally coupled to the SCR.

11. The water heater of claim 10, further comprising:

the second current source coupled to a gate of the SCR via a transistor.

12. The water heater of claim 7, further comprising:

the sensor activated switch comprising a thermally actuated circuit breaking device.

13. An apparatus comprising:

a solenoid lead;

a thermocouple to provide a first current source in a first direction to the solenoid lead;

a sensor activated switch disposed to switch current from a second current source to the solenoid lead in a second direction different from the first; and a fusable link coupling the solenoid lead with the thermocouple and coupling the solenoid lead with the second current source.

14. An apparatus comprising:

a solenoid lead;

a thermocouple to provide a first current source in a first direction to the solenoid lead;

a sensor activated switch disposed to switch current from a second current source to the solenoid lead in a second direction different from the first, the sensor activated switch comprising a thermally actuated circuit breaking device.

* * * * *